US005300998A

United States Patent [19]

Ogisawa et al.

[11] Patent Number: 5,300,998

[45] Date of Patent: Apr. 5, 1994

[54] HEATING APPARATUS HAVING A MOVABLE FILM PROTECTION MEMBER AND IMAGE FORMING APPARATUS USING SAME

[75] Inventors: Yuka Ogisawa, Kawasaki; Yuji Yamanaka, Tokyo, both of Japan

[73] Assignee: Canon Kabushiki Kaisha, Tokyo, Japan

[21] Appl. No.: 56,813

[22] Filed: May 4, 1993

Related U.S. Application Data

[63] Continuation of Ser. No. 808,584, Dec. 17, 1991, abandoned.

[30] Foreign Application Priority Data

Dec. 18, 1990 [JP] Japan ..... 2-403296
Jul. 23, 1991 [JP] Japan ..... 3-182506

[51] Int. Cl.[5] ..... G03G 15/20

[52] U.S. Cl. ..... 355/285; 219/216; 355/282

[58] Field of Search ..... 355/282, 285, 290, 295, 355/308, 309, 316, 321; 219/216, 469; 118/60; 432/60

[56] References Cited

U.S. PATENT DOCUMENTS

| | | | |
|---|---|---|---|
| 4,395,109 | 7/1983 | Nakajima et al. | 219/216 X |
| 4,954,845 | 9/1990 | Yano et al. | 355/290 |
| 4,998,121 | 3/1991 | Koh et al. | 346/160 |
| 5,026,276 | 6/1991 | Hirabayashi et al. | 432/59 |
| 5,027,160 | 6/1991 | Okada et al. | 355/282 |
| 5,045,887 | 9/1991 | Nakamura | 355/282 |
| 5,051,784 | 9/1991 | Yamamoto et al. | 355/285 |
| 5,083,168 | 1/1992 | Kusaka et al. | 355/285 |

FOREIGN PATENT DOCUMENTS

| | | | |
|---|---|---|---|
| 0224883 | 12/1984 | Japan | 355/285 |

*Primary Examiner*—A. T. Grimley
*Assistant Examiner*—William J. Royer
*Attorney, Agent, or Firm*—Fitzpatrick, Cella, Harper & Scinto

[57] ABSTRACT

A heating apparatus includes a heater; a movable film; a film heated by the heater; and a film protection member movable between a protecting position for protecting the film and an exposing position for exposing the film.

12 Claims, 6 Drawing Sheets

HEATING APPARATUS HAVING A MOVABLE FILM PROTECTION MEMBER AND IMAGE FORMING APPARATUS USING SAME

This application is a continuation of application Ser. No. 07/808,584 filed Dec. 17, 1991, now abandoned.

FIELD OF THE INVENTION AND RELATED ART

The present invention relates to a heating apparatus and an image forming apparatus using the same. The heating apparatus is usable to heat an image on a recording material to improve the image quality or to heat the image to fix an unfixed image on a recording material.

In a widely used conventional image fixing apparatus wherein the toner image is fixed on the recording medium supporting an unfixed toner image, the recording material is passed through a nip formed between a heating roller maintained at a predetermined temperature and a pressing or back-up roller having an elastic layer and press-contacted to the heating roller. The heating roller of the conventional fixing apparatus requires a large thermal capacity with the result of longer period of waiting type (non-usable period).

In order to solve this problem, U.S. Pat. Nos. 5,026,276; 4,954,845; 5,083,168; 5,051,784; 5,027,160; 4,998,121 and U.S. Ser. Nos. 668,333, 847,323, 409,431, 435,247, 440,380, 440,678, 444,802, 450,560, 496,957, 502,223, 542,018, 542,068, and 542,067 have proposed a heat fixing apparatus using a small thermal capacity fixed heater and a thin film. In this apparatus, the heat can be concentrated on the toner, and is advantageous in that the waiting period is short and that the power consumption can be saved.

Generally, it is difficult to completely remove occurrence of recording material jam, and therefore, a measure is to be taken for the jam disposal.

FIGS. 1 and 2 show an example of a heating apparatus having a structure for facilitating jam clearance operation. In FIG. 1, an image fixing film 7 in the form of an endless belt is trained around three parallel members, i.e., a driving roller (left side), a follower roller (right side) 9 and a low thermal capacity linear heater 1 disposed between and below the driving roller 8 and the follower roller 9.

The follower roller 9 also functions as a tension roller for the fixing film 7. The fixing film rotates at a predetermined peripheral speed in the clockwise direction by the clockwise rotation of the driving roller 8.

A pressing roller 10 has a rubber elastic layer having a good parting property, such as silicone rubber or the like and is press-contacted to the heater 1 with the bottom travel of the fixing film 7 therebetween. The pressing roller is press-contacted to the heater at the total pressure of 4–7 kg by a pressing lever 31, a pressing spring 33, and a pressure releasing lever 32. It rotates co-directionally, that is, in the counterclockwise direction, with the fixing film 7.

As shown in FIG. 2, when the pressure releasing lever 32 is pressed in a direction indicated by an arrow a, a positioning pin 34 is disengaged so that the pressing roller 10 is released. Then, the jammed recording material is removed. The pressing lever 31 is raised by an unshown cam, and the pressure releasing lever 32 is moved to lock it, again. When, however, the heating apparatus is not exposed, it is difficult to remove the jammed paper despite the pressure release, when the paper is wrapped around the pressing roller or when the jammed sheets is in the form of bellows. Therefore, it is preferable to open the sheet discharge side of the heating apparatus. However, when the discharging side of the heating apparatus using the film is opened, the film is exposed with the risk of the operator touching the film. The film is thin, and therefore, is easily damaged.

SUMMARY OF THE INVENTION

Accordingly, it is a principal object of the present invention to provide a heating apparatus in which a jammed sheet can be removed without damage to the film.

It is another object of the present invention to provide an image forming apparatus in which the discharging side of an image fixing means is opened, from the outside of the apparatus.

It is a further object of the present invention to provide a heating apparatus having a film protection member movable between film protecting position and a film exposing position.

It is a further object of the present invention to provide an image forming apparatus wherein the film protection member is movable to the film protecting position in interrelation with the opening operation for opening the sheet discharging side of the fixing means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, embodiments of the present invention will be described.

Figure 3:
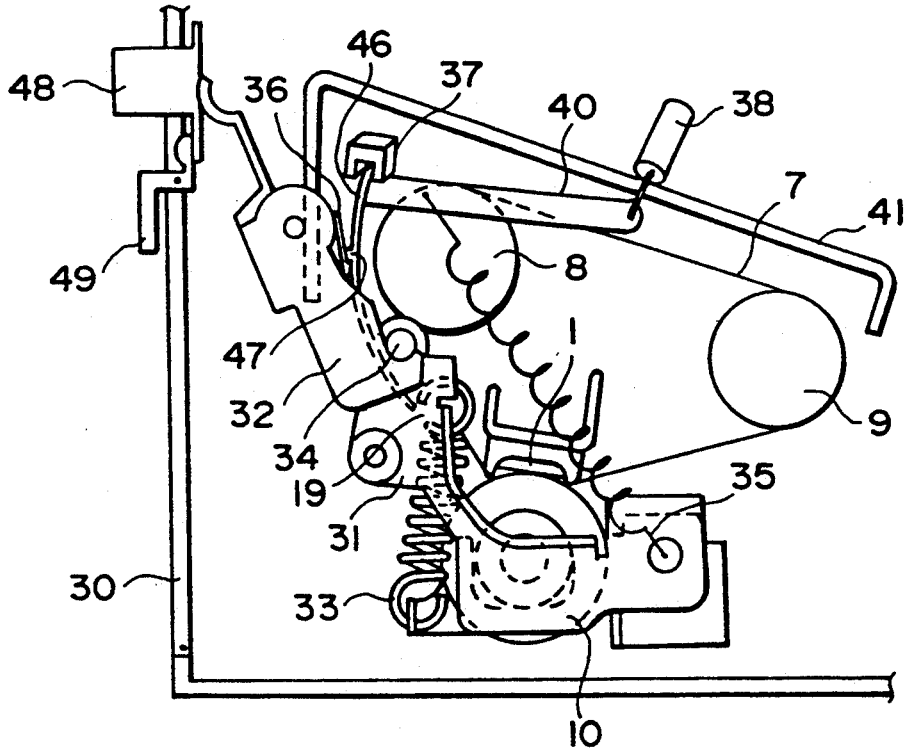
FIGS. 3 and 4 are sectional views of a heating apparatus according to an embodiment of the present invention.
Figure 4:
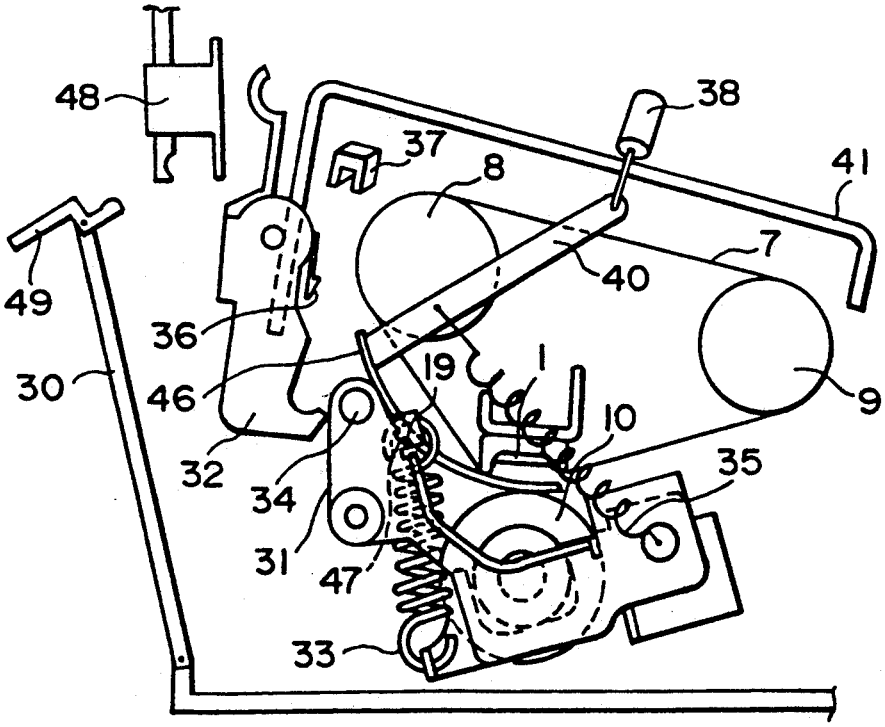

Referring to FIGS. 3 and 4, there is shown an image fixing apparatus which is an exemplary heating apparatus according to an embodiment of the present invention. A fixing film 7 is trained around a driving roller 8, a follower roller 9 and a heater 1 and is driven at the same peripheral speed as the movement speed of the recording material in the clockwise direction by the driving roller. A pressing roller 10 is press-contacted to the heater 1 to form a nip with the fixing film therebetween. By passing the recording material bearing an unfixed toner image, the toner image is heated and pressed to be fixed thereon. The recording material on which the image has now been fixed is discharged to the outside of the apparatus through a discharging, outlet (not shown) of the sheet discharging door 30.

A film protection member 46 is made of heat resistive resin such as PPS (polyphenylene sulfide) or the like and is normally at a position not covering the neighborhood of the nip, as shown in FIG. 3.

When a pressure releasing button 48 is pressed, the pressure releasing lever 32 moves, as shown in FIG. 4, and a holding pin 47 for holding the film protection member is disengaged from a stopper leaf spring 36 for the film protection member. Therefore, the film protection member is pulled by the tension spring 35 to rotate along the fixing film 7 about a rotational center 19 so that it covers the fixing film 7 from the nip portion to the sheet discharging side.

The sheet discharging door 30, which may serve as an access opening, is prevented from being opened without actuation of the pressure releasing button 48. In other words, the pressure releasing button prohibits opening of the sheet discharging door 30 unless the film protection member is at the film protecting position. When the sheet discharging door 30 is opened by pulling a sheet discharging door knob 49, the film protection member 46 is already at the position covering the fixing film 7. By opening the sheet discharging door 30, the power supply switch is deactuated. When it is closed, the power switch is actuated. When an image formation start signal is generated by depressing an unshown copy button, a stepping motor 38 rotates to rotate the lever 40 to raise the film protection member 46 until it is sensed by a film protecting member position detecting photosensor 37.

At this time, a pressing lever 31 is raised by an unshown cam and is fixed by a pressure releasing lever 32, so that the pressing roller 10 is urged to the film. Simultaneously, the holding pin 47 is engaged with the stopper leaf spring 36 mounted on the pressure releasing lever 32. By this, the film protection member 46 is retained at its upper position without obstructing the movement of the recording material during the fixing operation. In this FIG. 3, reference numeral 41 designated an upper stay.

In this embodiment, the film protection member 46 is supported at the sheet discharging side. It is a possible alternative that it is supported at the sheet feeding side and that the film protection member 46 rotates in the same direction as the movement direction of the recording material to cover the sheet discharging side of the film, when the pressure is released.

It is a further alternative that the film protection member is made of fluorinated resin sheet in the form of bellows which is collapsed normally, but is expanded upon necessity to protect the film, using a rink mechanism.

Figure 5:
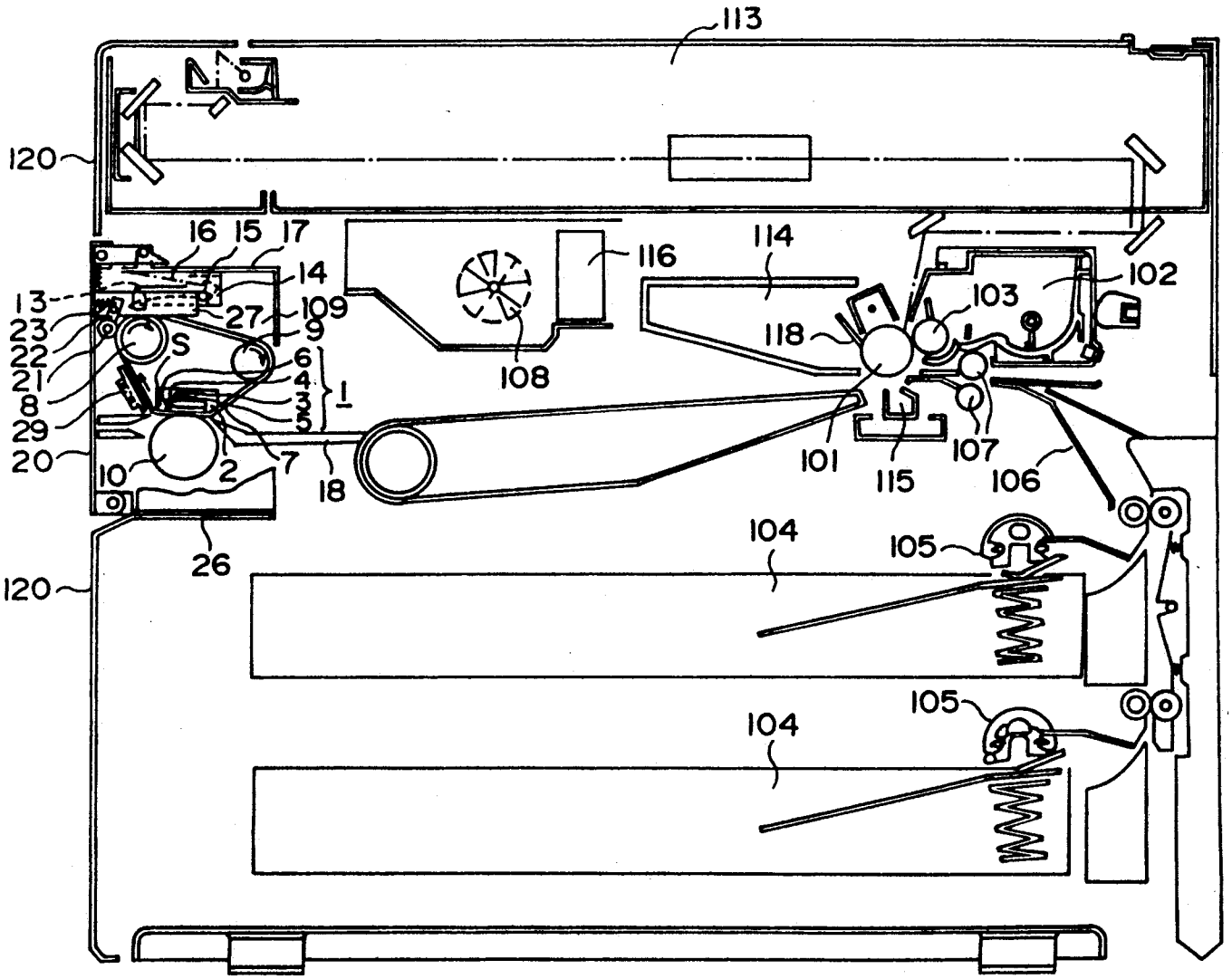
FIG. 5 is a sectional vie of an image forming apparatus according to an embodiment of the present invention.

Referring to FIG. 5, another embodiment will be described. FIG. 5 is a sectional view of an image forming apparatus of an electrophotographic type. It comprises a photosensitive drum 101, a developing device 102, a developer sleeve 103, a cassette 104 for accommodating copy sheets, a sheet feeding roller 105, a guide 106, a registration roller 107, a heat discharging fan 108 and an image fixing device 109. It further comprises an optical system 113 for illuminating an original on an original platen glass by an illumination lamp and for projecting an image of the original onto the photosensitive drum 1 through a first mirror, a lens and second through sixth mirrors.

The fan 108 is disposed downstream the photosensitive drum 101 and a cleaner unit 114 therefor and upstream of the fixing unit 109. Because of this arrangement, the ozone produced when the photosensitive drum is electrically charged (primary charging) or when the toner image is transferred from the photosensitive drum onto the copy sheet, can be discharged by the fan 108 through a filter 116 at the sheet discharging side.

In operation, a start key is actuated, and immediately thereafter, the main motor (not shown) starts its operation. Then, the sheet feeding roller 105 receives the driving force through a one-rotation clutch mechanism comprising a solenoid and a spring clutch, and the sheet feeding roller 105 rotates through one full-turn, so that the copy sheet is fed out of the cassette 104. The copy sheet is then guided to the registration roller 107 along the guide 106. Since the registration rollers 107 do not rotate, the leading edge of the copy sheet is gripped by the nip of the registration rollers. The trailing part of the copy sheet is further fed, so that a loop of the sheet is formed, and then, the sheet stops. By doing so, the copy sheet is fed to the transfer station only after aligned by the registration rollers.

On the other hand, the optical system starts to scan the photosensitive drum 101 at such a timing that the leading edge of the sheet fed by the registration roller 107 is aligned with the latent image on the photosensitive drum. Then, the drum 101 is exposed an original image through first-sixth mirrors. The latent image is developed with use of transfer device 115 with powdery toner into a powder image (unfixed). The image is transferred onto the copy sheet. Excess toner is removed by cleaner 118.

The copy sheet now having the transferred unfixed toner image is fed to the fixing device. In the fixing device, it is heated and pressed so that the image is fixed on the copy sheet. Reference numerals 120 and 20 are left side plate and a sheet discharging door for the fixing apparatus. They are substantially on a common plane.

When the discharging door is opened, the event is detected by an unshown sensor, and the power switch is deactuated.

Figure 6:
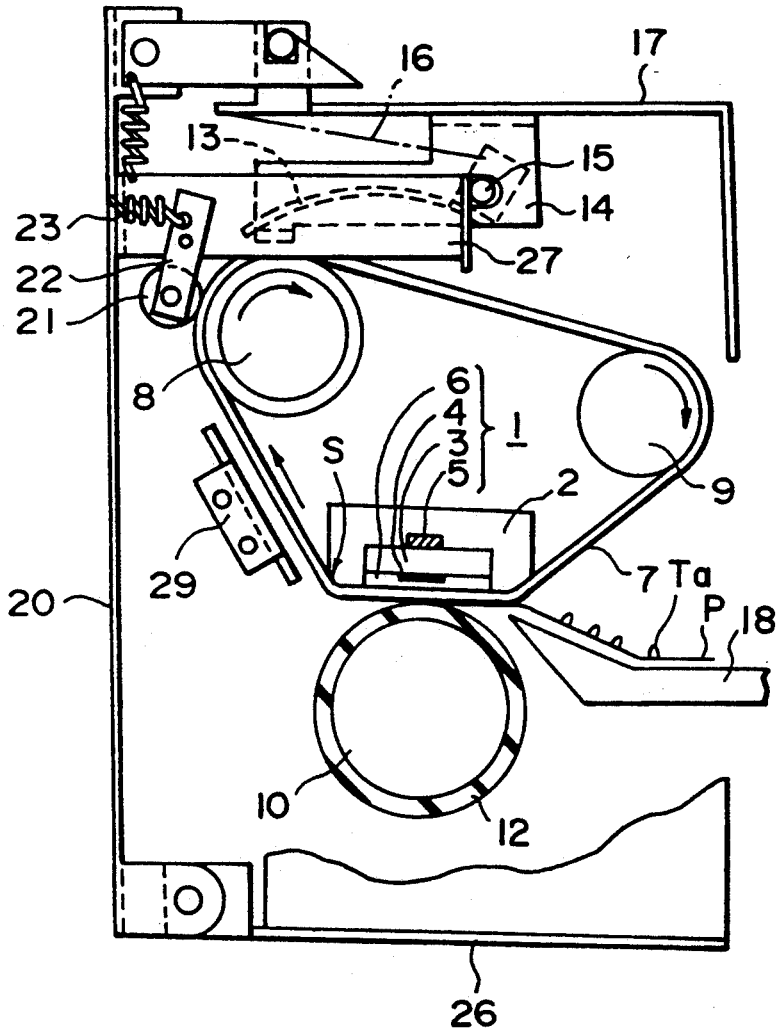
FIG. 6 is an enlarged sectional view of an image fixing station of the image forming apparatus of FIG. 5 in which a sheet discharging door is closed.
Figure 7:
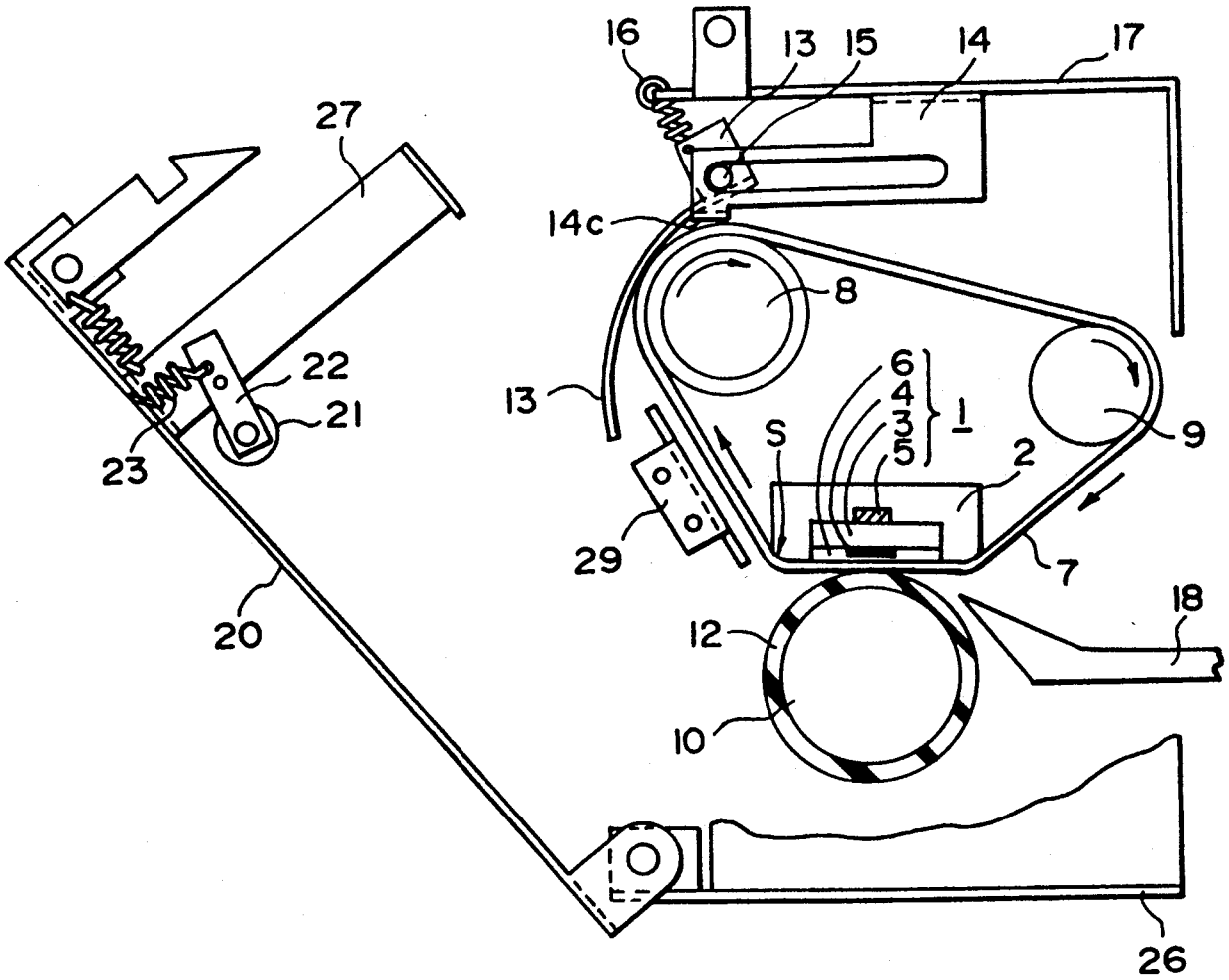
FIG. 7 is an enlarged sectional view of an image forming apparatus of FIG. 5 in which the sheet discharging door is opened.
Figure 8:
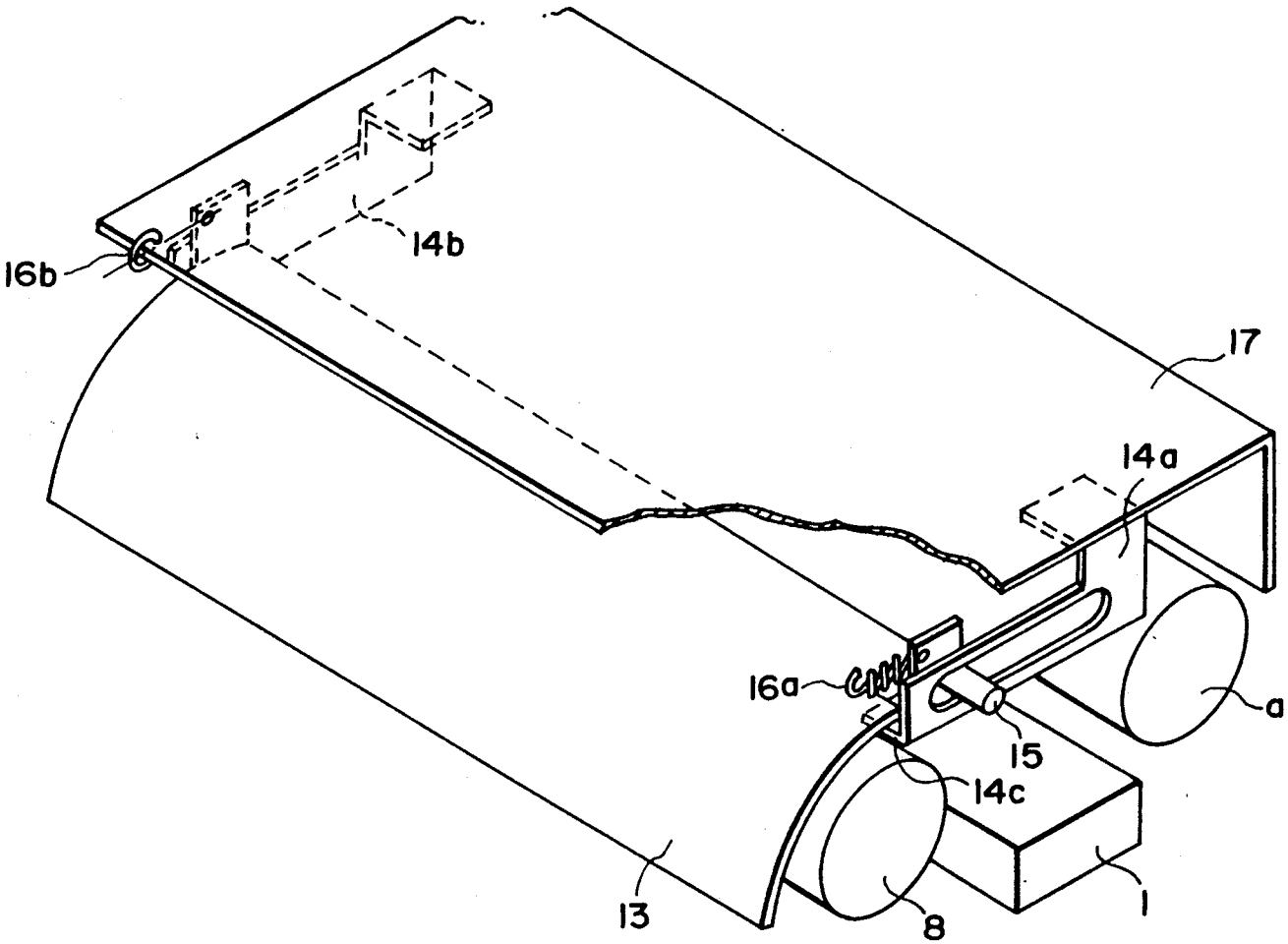
FIG. 8 is a perspective view of a part of the image fixing station of the image forming apparatus of FIG. 5.

The fixing station will be described in detail. FIG. 6 and 7 are enlarged sectional views of the image fixing station in which FIG. 6 is the state when the sheet discharging door is closed; and FIG. 7 is the state when the door is opened. FIG. 8 is a partial perspective view.

The fixing station comprises a fixing film 7 in the form of an endless film, which is stretched around three members, i.e., a left driving roller 8, a right follower roller 9 and a low thermal capacity linear heater 1 (heater) disposed below and between the rollers 8 and 9.

The follower roller 9 also functions as a tension roller for the endless fixing film 7. When the driving roller 8 rotates in the clockwise direction, the fixing film 7 is driven at the same speed as the speed of the recording material P carrying on its top surface the unfixed toner image Ta in the clockwise direction without crease, snaking movement and delay.

A pressing member 10 in the form of a pressing roller comprises a rubber elastic layer 12 having a good parting property, of silicone rubber or the like. The pressing roller 10 is pressed to the bottom surface of the heater 1 by an unshown urging means at the total pressure of 4–7 kg to form a nip with the bottom travel of the endless film sandwiched therebetween. It rotates in the counterclockwise direction, that is, codirectionally with the recording sheet P.

The heater 1 is in the form of a low thermal capacity linear heater extending in a direction crossing with the film 7 surface movement direction (film width direction). It comprises a heater base 3 having a high thermal conductivity, a heat generating resistor generating heat upon electric power supply thereto, and a temperature sensor 5. It is mounted on a heater support 2.

The heater support 2 supports the heater 1 with thermal insulation and is made of a material having heat insulative nature, high heat durability and sufficient rigidity.

It may be made of high heat durability resin such as PPS (polyphenylene sulfide), PAI (polyamide imide), PI (polyimide), PEEK (polyether ether ketone) or liquid crystal polymer material, or a compound material of such resin material and ceramics, metal, glass or the like material.

A heater base 3 has a sufficient heat resistivity, heat insulation nature and a sufficiently low thermal capacity. For example it is in the form of an alumina plate having a thickness of 1.0 mm, a width of 16 mm and a length of 340 mm.

The heat generating material 4 is applied by screen printing or the like along a longitudinal line substantially at the center, of the bottom surface of the base 3 (the surface contactable to the film 7). The heat generating material 4 is, for example, Ag/Pd (silver palladium), $Ta_2N$ or another electric resistor material having a thickness of approximately 10 microns and a width of 1–7 mm. It is coated with a heat resistive glass 6 in the thickness of approximately 10 microns, as a surface protection layer.

An example of a temperature sensor 5 is applied by screen printing or the like substantially at a center of a top surface of the base 3 (the side opposite from the side having the heat generating material 4). It is made of Pt film having low thermal capacity. Another example of the temperature sensor is a low thermal capacity thermister contacted to the base 3.

The linear or stripe heater 1 is connected with the power source at the longitudinal opposite ends, so that the heat is generated uniformly along the heater 1. The power source in this example provides AC 100 V, and the phase angle of the supplied electric power is controlled by an unshown control circuit including triac in accordance with the temperature detected by the temperature detecting element 5.

The fixing film 7 is in the form of a single layer or multi-layer film having a total thickness of not more than 100 microns, preferably not more than 40 microns. The fixing film 7 shows sufficient heat resistivity, parting property and durability or the like.

The film protection member 13 is made of metal plate or heat resistive resin and has pins 15 at the opposite ends. Pins 15 are engaged in elongated slots of supporting plates 14*a* and 14*b*. Springs 16*a* and 16*b* are included for biasing. The, supporting plate 14 is mounted on the upper stay 17, and when the upper stay 17 is removed, the film protection member 13 is also removed so that the film can be easily cleaned. Thus, the film protection member 13 is mounted for rotation and sliding movement and is urged to the left by a spring 16 in FIGS. 2 and 3. The sheet discharging door 20, which may serve as an access opening, is rotatably supported on the side plate 26 and is provided with an urging plate 27 and an oil applying roller 21. Roller 21 is mounted via spring 23 and arm 22. The fixed film protection member 29 is mounted on the side plate 26 and does not move even when the discharging door 20 is opened, so that it overlaps with the film protection member 13 to completely cover the film 7.

In the state where the sheet discharging door 20 is closed (FIG. 6), an oil applying roller impregnated with parting oil is contacted to the fixing film 7 to apply the oil onto the surface at a position where it is faced to the driving roller 8.

When the sheet discharging door 20 is opened, the urging plate 27 escapes in interrelation with the opening operation of the sheet discharging door 20, so that the spring 16 moves the film protection member 13 to a position for covering the fixing film 7 as shown in FIG. 3, and covers the oil applying roller contact position.

Since the oil applying roller is integral with the sheet discharging door 20, it is moved away from the fixing film when the sheet discharging door 20 is opened.

Thus, the maintenance operation such as exchange of the oil application roller or the like is made easier, and in addition, the oil consumption is minimized.

When the sheet discharging door 20 is closed, the free end of the urging plate 27 abuts the pin 15 to rotate the film protection member 13 to the right. At this time, the film protection member 13 moves to the right while being confined by the bent portion 14*c* of the supporting plate 14, and rotates in the clockwise direction about the pin 15. By using such movement of the film protection member 13, the film protection member 13 requires only a small space.

Figure 1:
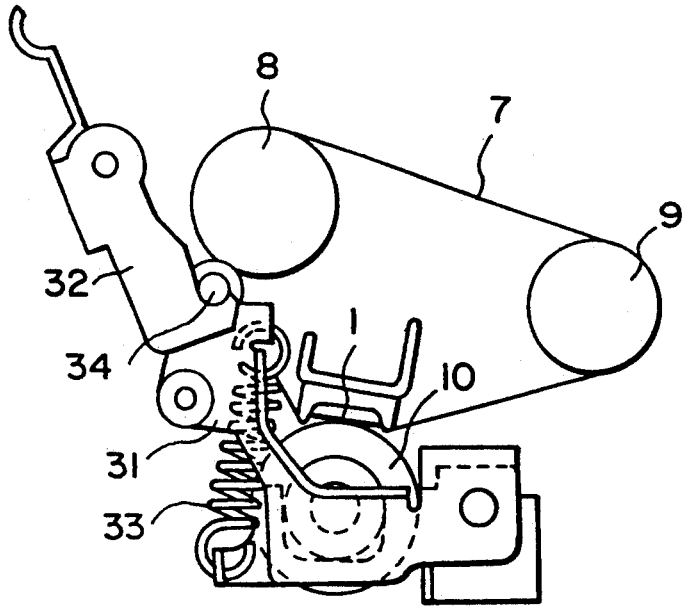
FIGS. 1 and 2 are sectional views of a heating apparatus not using the present invention.
Figure 2:
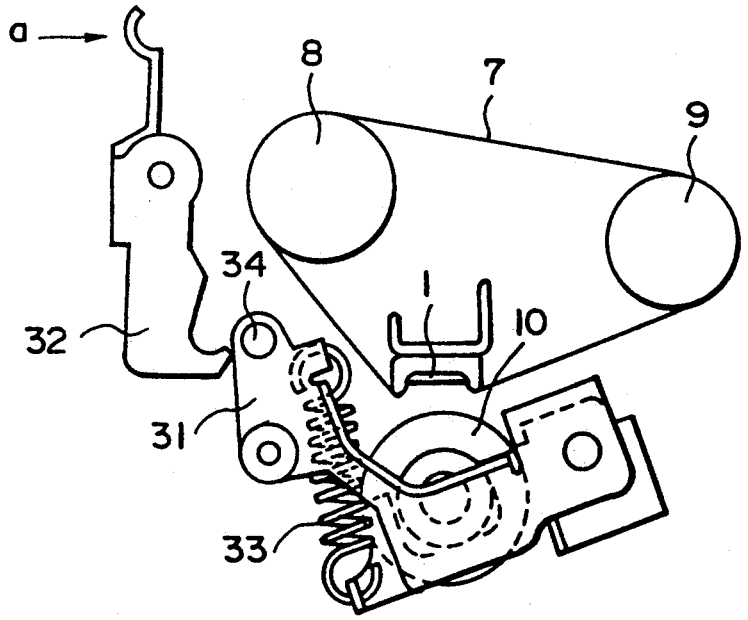

During the normal fixing operation, the film protection member is moved to the position permitting the downstream of the nip to be exposed, as shown in FIG. 2, and therefore, the vapor produced by the copy sheet during the fixing operation is prevented from stagnating in the neighborhood of the driving roller and condensing on the film.

The film protection member is movable through mechanical interrelation with the sheet discharging door, and therefore, it functions even when the power switch is actuated. This is particularly effective in the case of this embodiment in which when the sheet discharging door is opened, the main power source is deactuated.

The fixing operation will be described. Upon image formation start signal, an unfixed toner image is formed on a recording material sheet by the image forming station. The recording material sheet is guided by a guide 18 to enter between the fixing film 7 and the pressing roller 10 at the nip (fixing nip) provided by the heater 1 and the pressing roller 10. The sheet passes through the nip between the heater 1 and the pressing roller 10 together with the fixing film 7 without surface deviation, crease or lateral shifting while the toner image carrying surface being in contact with the bottom surface with the fixing film 7 moving at the same speed as the sheet.

The heater 1 is supplied with electric power at a predetermined timing after generation of the image formation start signal so that the toner image is heated by the nip so as to be softened and fused.

The fixing film 7 is acutely deflected at an angle for example of about 45 degrees at an edge S (the radius of curvature is approximately 2 mm), that is, the edge having a large curvature in the heater support 2. By this, the sheet advanced together with the film 7 in the nip is separated by the curvature from the fixing film 7 at the edge S. Then, the sheet is discharged to the sheet discharging tray. Until the sheet is discharged, the toner is sufficiently cooled and solidified and therefore is completely fixed.

In this embodiment, the heat generating element 4 and the base 3 of the heater 1 have low thermal capacity, and in addition, it is supported on the support 2 through thermal insulation, and therefore, the surface temperature of the heater 1 in the nip quickly reaches a sufficiently high temperature in consideration of the toner fusing point (or a temperature at which the toner can be fixed on the sheet), and therefore, the stand-by temperature control (to increase the temperature of the heater 1 to a predetermined level beforehand), and therefore, the power consumption can be saved, and the temperature rise can be prevented.

In this embodiment, the image is formed on the recording material through the electrophotographic process, but another image forming process such as electrostatic recording process is usable. The heating apparatus of this invention is not limitedly applicable to the image fixing, but is applicable to improve the surface property of the image, the transparency or the like.

While the invention has been described with reference to the structures disclosed herein, it is not confined to the details set forth and this application is intended to cover such modifications or changes as may come within the purposes of the improvements or the scope of the following claims.

We claim:

1. A heating apparatus, comprising:

a heater;

an endless film extended around said heater and movable with a recording material;

a pressing member forming a nip with said heater, said film passing through the nip;

access means for providing access to a jammed recording material; and a film protection member for protecting said film;

wherein said film protection member is movable between a covering position for covering at least a portion of that part of said film which is otherwise exposed by said access means and not adjacent to said heater, and a retracted position retracted from said covering position.

2. An apparatus according to claim 1, further comprising pressure releasing means for removing pressure between said film and said pressing member, wherein said film protection member moves to the film covering position in interrelation with operation of said pressure releasing means.

3. An apparatus according to claim 1, wherein said film protection member is curved to be concave at a side near said film, along movement direction of said film.

4. An apparatus according to claim 1, wherein said film protection member covers said film at its portion downstream of the nip with respect to a movement direction of said film.

5. An apparatus according to claim 1, further comprising means for preventing the access means from opening when said film protection member is not at the film covering position.

6. An apparatus according to claim 1, wherein an unfixed image on a recording material is heat-fixed by heat from said heater through said film.

7. An image forming apparatus, comprising:

a housing;

image forming means for forming an unfixed image on a recording material; and fixing means for fixing the image on the recording material, said fixing means including a heater, an endless film extended around said heater and movable with a recording material; a pressing member forming a nip with said heater with said film passing through the nip; access means for opening a portion of said housing to expose space around the nip, and a film protection member for protecting said film; wherein said film protection member is movable between a covering position for covering at least a portion of that part of said film which is otherwise exposed upon opening by said access means and which is not adjacent to said heater, and a retracted position retracted from said covering position, and wherein said pressing member moves to the covering position, in response to said opening.

8. An apparatus according to claim 7, wherein said film protection member is retracted in interrelation with a closing operation of said access means.

9. An apparatus according to claim 7, further comprising parting agent applying means movable toward and away from said film in interrelation with an opening and closing operation of said access means, wherein said film protection member covers a portion where a parting agent is applied by said parting agent applying means.

10. An apparatus according to claim 9, wherein said applying means is mounted on said access means.

11. An apparatus according to claim 7, further comprising a stationary film protection member cooperable with said movable film protection member, said stationary film protection member extends along said film.

12. An apparatus according to claim 7, wherein said access means exposes an area downstream of said nip.

* * * * *

UNITED STATES PATENT AND TRADEMARK OFFICE

CERTIFICATE OF CORRECTION

PATENT NO. : 5,300,998
DATED : April 5, 1994
INVENTOR(S) : YUKA OGISAWA, ET AL.

It is certified that error appears in the above-indentified patent and that said Letters Patent is hereby corrected as shown below:

Column 1,
Line 24, "of" should read --of a--.

Column 2,
Line 39, "vie" should read --view--.

Column 3,
Line 1, "discharging," should read --discharging--.

Column 4,
Line 1, "downstream" should read --downstream of--;
Line 17, "roller" should read --rollers--;
Line 27, "roller" should read --rollers--;
Line 29, "exposed" should read --exposed to--;
Line 38, "are" should read --are a--; and
Line 44, "FIG. 6" should read --FIGS. 6--.

Column 5,
Line 41, "mister" should read --mistor--.

Signed and Sealed this

Eighteenth Day of October, 1994

Bruce Lehman

*Attest:*

BRUCE LEHMAN

*Attesting Officer*

*Commissioner of Patents and Trademarks*